US010393052B2

(12) United States Patent
Makino et al.

(10) Patent No.: US 10,393,052 B2
(45) Date of Patent: Aug. 27, 2019

(54) INJECTOR CONTROL DEVICE AND INJECTOR CONTROL METHOD

(71) Applicant: Mitsubishi Electric Corporation, Tokyo (JP)

(72) Inventors: Tomokazu Makino, Tokyo (JP); Toru Tanaka, Tokyo (JP); Osamu Maeda, Tokyo (JP); Hideki Hagari, Tokyo (JP); Hiroyuki Fukuyama, Hyogo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 191 days.

(21) Appl. No.: 15/670,347

(22) Filed: Aug. 7, 2017

(65) Prior Publication Data

US 2018/0112614 A1 Apr. 26, 2018

(30) Foreign Application Priority Data

Oct. 20, 2016 (JP) ..... 2016-205981

(51) Int. Cl.

| | |
|---|---|
| ***F02D 41/20*** | (2006.01) |
| *F02M 45/12* | (2006.01) |
| *F02D 41/24* | (2006.01) |

(52) U.S. Cl.

CPC ..... *F02D 41/20* (2013.01); *F02D 41/2467* (2013.01); *F02D 2041/2034* (2013.01); *F02D 2041/2055* (2013.01); *F02D 2200/0618* (2013.01); *F02M 45/12* (2013.01)

(58) Field of Classification Search

CPC ..... F02D 41/20; F02D 41/2467; F02D 2041/2034; F02D 2041/2055; F02D 2200/0618; F02M 45/12

USPC ..... 123/446

See application file for complete search history.

(56) References Cited

U.S. PATENT DOCUMENTS

2012/0239278 A1* 9/2012 Becker ..... F02D 41/20 701/105
2016/0237935 A1* 8/2016 Tanaka ..... F02D 41/247

FOREIGN PATENT DOCUMENTS

JP 2015-151871 A 8/2015
WO 2013/191267 A1 12/2013

* cited by examiner

*Primary Examiner* — Mahmoud Gimie
(74) *Attorney, Agent, or Firm* — Sughrue Mion, PLLC; Richard C. Turner

(57) ABSTRACT

A target injector valve opening period is calculated based on a target fuel injection amount, and an injector (2) is controlled by a current supply control unit (51) in accordance with an injector drive period acquired based on the target injector valve opening period. An actual valve closing delay period is calculated based on a drive waveform of the injector (2) at this time, and a difference between an actual valve closing delay period and a valve closing delay period calculated from a target injector valve opening period is learned. Then, the injector drive period is corrected by feedback control using a result of this learning.

8 Claims, 5 Drawing Sheets

INJECTOR CONTROL DEVICE AND INJECTOR CONTROL METHOD

BACKGROUND OF THE INVENTION

1. Field of the Invention

The present invention relates to an injector control device and an injector control method.

2. Description of the Related Art

In recent years, a regulation on soot particles contained in exhaust gas is becoming stricter. An internal combustion engine configured to inject gasoline in a cylinder generates a relatively large amount of soot particles. Therefore, instead of decreasing a gasoline injection amount for one time, there is proposed a method involving dividing and performing the gasoline injection in plural times, thereby complying with the regulation on the soot particles.

In order to decrease the injection amount for one time, the drive period of the injector only needs to be decreased. However, it is not easy to precisely control a small injection amount as disclosed in WO 2013/191267 A1. In order to solve this problem, in WO 2013/191267 A1, there is proposed a control device configured to calculate a second-order derivative of a solenoid terminal voltage of the injector after an end of the current supply to detect a maximal value of the second-order derivative, to thereby detect an actual valve closing time point.

Moreover, in Japanese Patent Application Laid-open No. 2015-151871, there is disclosed a control method involving detecting and learning a valve closing time point of an injector, thereby correcting a current supply period to a coil of the injector. When the temperature of the coil of the injector changes, an electric resistance of the coil changes in response to the temperature change. As a result, a variation caused by the temperature of the coil is generated in a Ti-q characteristic indicating a relationship between a current supply period Ti to the coil and an injection amount q of the injector. In Japanese Patent Application Laid-open No. 2015-151871, an actual injection amount of the injector is detected and learned in consideration of this variation, and the current supply period to the coil of the injector is corrected based on the past detection values.

When the injector is controlled in accordance with the current supply period to the solenoid calculated based on the target fuel injection amount, the fuel injection amount varies due to individual difference of the injector.

However, in WO 2013/191267 A1, although the detection method for the valve closing time point is disclosed, no specific disclosure is made on the correction method for the current supply period to the solenoid of the injector.

Moreover, the control method disclosed in Japanese Patent Application Laid-open No. 2015-151871 assumes the operation variation due to the temperature change in the coil of the injector, and is configured to correct degradation in repeatability caused by the operation variation due to the temperature change in the coil of the injector during use. Thus, the control method disclosed in Japanese Patent Application Laid-open No. 2015-151871 does not correct the current supply period to the coil so as to attain a valve opening period corresponding to a target fuel injection amount being a reference characteristic. Further, Japanese Patent Application Laid-open No. 2015-151871 does not assume an individual variation due to a production variation of the injector in, for example, weights and clearances of a spring, a coil, and a needle of the injector, and hence the control method disclosed in Japanese Patent Application Laid-open No. 2015-151871 cannot correct the variation of the fuel injection amount due to the individual variation of the injector.

SUMMARY OF THE INVENTION

The present invention has been made in view of the above-mentioned problems, and therefore provides an injector control device and an injector control method that are capable of decreasing a variation of a fuel injection amount due to an individual variation of an injector.

According to one embodiment of the present invention, there is provided an injector control device, which is configured to control an injector, the injector including: a fuel passage configured to allow a fuel to be injected for an internal combustion engine to pass therethrough; a needle valve configured to separate from a valve seat provided at a fuel injection opening of the fuel passage to open the fuel passage, and to abut against the valve seat to close the fuel passage; and a solenoid configured to attract the needle valve in a valve opening direction when a current is supplied to the solenoid, the injector control device including: a target injection amount calculation unit configured to calculate a target injection amount of the fuel injected by the injector in response to an operation state of the internal combustion engine; a target injector valve opening period calculation unit configured to calculate, based on the target injection amount, a target injector valve opening period corresponding to the target injection amount, in accordance with characteristic data on an injector valve opening period with respect to a fuel injection amount; an injector valve opening delay period calculation unit configured to calculate, based on the target injector valve opening period, a valve opening delay period from a current supply start time point of the solenoid to a valve opening time point at which the valve seat and the needle valve of the injector separate from each other, in accordance with characteristic data on the valve opening delay period with respect to the injector valve opening period; a post-learning injector valve closing delay period calculation unit configured to calculate, based on the target injector valve opening period, a valve closing delay period from a current supply end time point of the solenoid to a valve closing time point at which the valve seat and the needle valve of the injector abut against each other, in accordance with a learning map having the injector valve opening period as at least one axis and storing a learned value of the valve closing delay period; an injector drive period calculation unit configured to calculate a current supply period to the solenoid based on the target injector valve opening period, the valve opening delay period, and the valve closing delay period; a current supply control unit configured to supply the current to the solenoid of the injector in accordance with the current supply period to the solenoid, to thereby drive the injector; an injector valve closing time point calculation unit configured to detect an actual valve closing time point at which the valve seat and the needle valve actually abut against each other, based on a drive voltage waveform of the solenoid when the current supply control unit drives the injector based on the current supply period to the solenoid; an injector actual valve closing delay period calculation unit configured to calculate an actual valve closing delay period from the current supply end time point of the solenoid to the actual valve closing time point, based on the actual valve closing time point, an actual current supply start time point of the solenoid, and an actual current supply period to the solenoid; an injector valve closing delay period difference calculation unit configured to calculate a valve closing delay period difference, which is a difference between the valve closing delay period calculated by the post-learning injector valve closing delay period calculation unit and the actual valve closing delay period calculated by the injector valve closing time point calculation unit; and an injector valve closing delay period learned-value calculation unit configured to update the learned value of the valve closing delay period in the learning map, based on the valve closing delay period difference, the post-learning injector valve closing delay period calculation unit being configured to use, at a next calculation timing, the learning map in which the learned value of the valve closing delay period updated by the injector valve closing delay period learned-value calculation unit is stored, to thereby calculate the valve closing delay period.

The injector control device according to the present invention is configured to learn the characteristic of the valve closing delay period of the injector, and use the learning result to control the drive period of the injector corresponding to the target fuel injection amount, thereby decreasing the variation of the fuel injection amount due to the individual variation of the injector.

DESCRIPTION OF THE EMBODIMENTS

First Embodiment

Figure 1:
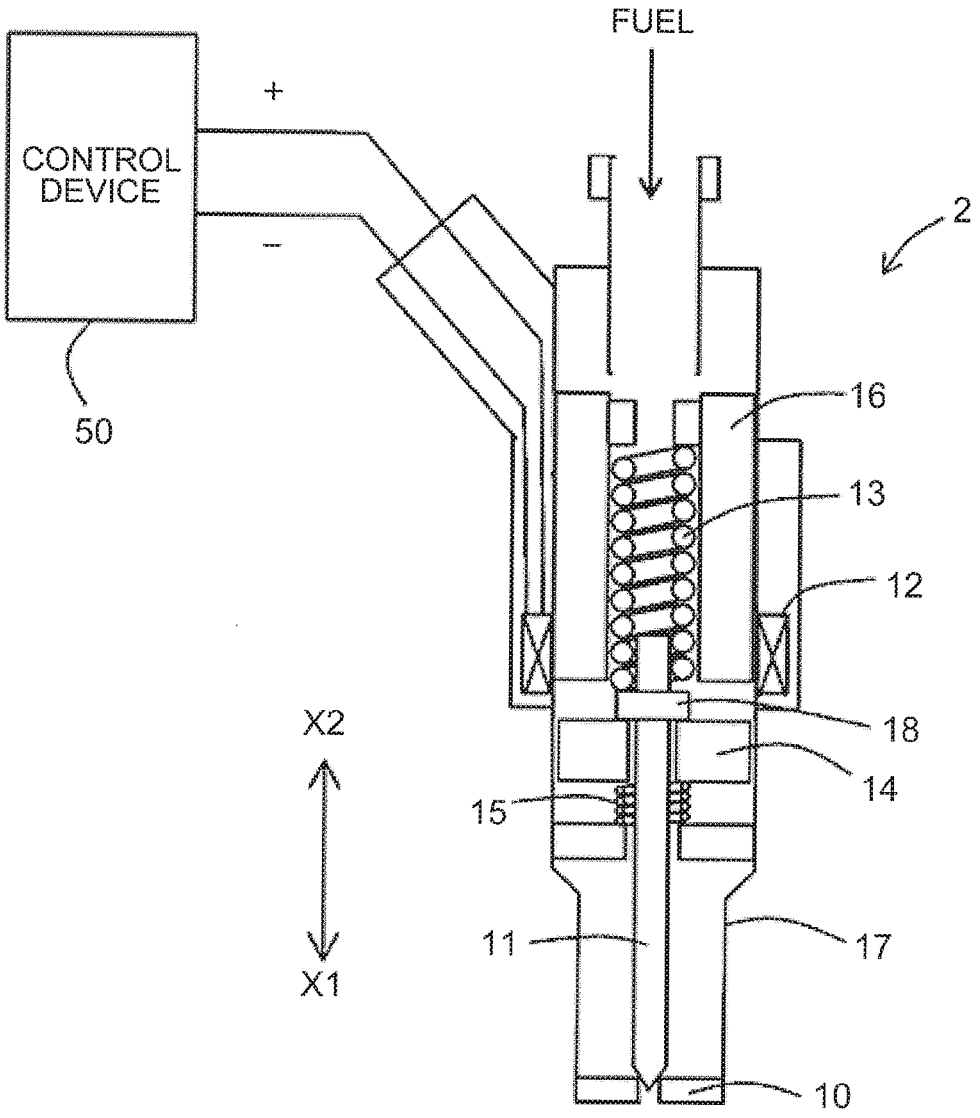
FIG. 1 is a schematic cross sectional view for illustrating a configuration of an injector to be controlled by an injector control device according to a first embodiment of the present invention.

A description is now given of an injector control device (hereinafter simply referred to as control device 50) according to a first embodiment of the present invention referring to the drawings. According to the first embodiment, the control device 50 constructs a part of a control device for an internal combustion engine, and a drive circuit for injectors 2 is built into the control device 50. The drive circuit for the injectors 2 may be constructed independently of the control device 50. According to the first embodiment, the control device 50 is configured to control the injectors 2 provided for the internal combustion engine of a vehicle.

First, a description is given of a configuration of the injector 2. FIG. 1 is a cross sectional view for schematically illustrating structure of the injector 2 according to the first embodiment. As illustrating in FIG. 1, the injector 2 includes a valve seat 10 provided at an injection opening of a fuel passage, a needle valve 11 configured to open or close the fuel passage, and a solenoid 12 configured to drive the needle valve 11 to open or close the fuel passage. The needle valve 11 is configured to move toward a valve closing direction X1, and abut against the valve seat 10, thereby bringing the fuel passage into a closed state. Moreover, the needle valve 11 is configured to move toward a valve opening direction X2, and separate from the valve seat 10, thereby bringing the fuel passage into an open state.

The injector 2 further includes a movable element 14, a zero-position spring 15, and a main spring 13. The movable element 14 is made of a magnetic substance, and is configured to be, when a current is supplied to the solenoid 12, attracted toward the valve opening direction X2 by a magnetic force generated by the current supply. The zero-position spring 15 is provided on the valve closing direction X1 side with respect to the movable element 14. The zero-position spring 15 is configured to energize the movable element 14 toward the valve opening direction X2. The needle valve 11 includes a flange 18. The flange 18 is provided on an upper end side with respect to a center in an axial direction of the needle valve 11. The flange 18 may be provided at an upper end in the valve opening direction X2 of the needle valve 11. The main spring 13 is disposed on the valve opening direction X2 side with respect to the flange 18. The main spring 13 is configured to energize the needle valve 11 toward the valve closing direction X1. An energizing force of the main spring 13 is stronger than an energizing force of the zero-position spring 15.

The needle valve 11 is constructed by a member in a rod shape. A lower end of the needle valve 11, namely, the tip in the valve closing direction X1 is tapered to a point. When the current is not supplied to the solenoid 12, the needle valve 11 moves toward the valve closing direction X1 by the energizing force of the main spring 13 and a fuel pressure. When the tip of the needle valve 11 abuts against the injection opening of the valve seat 10, the tip of the needle valve 11 closes the injection opening, and the fuel passage is brought into the closed state.

The injector 2 includes a magnetic core 16 and a case 17. The case 17 is formed into a tubular shape, and is configured to internally store the respective components of the injector 2. The solenoid 12 is constructed by a cylindrical coil wound on a bobbin. The magnetic core 16 is disposed between the solenoid 12 and the main spring 13.

The movable element 14 is made of the magnetic substance formed into a hollow cylindrical shape. Both an upper end and a lower end of the movable element 14 are open. The needle valve 11 is disposed so as to pass through the hollow of the movable element 14. The movable element 14 is disposed on the valve closing direction X1 side with respect to the flange 18. The movable element 14 and the needle valve 11 can relatively move with respect to each other. The zero-position spring 15 is disposed on the valve closing direction X1 side with respect to the movable element 14, and is configured to energize the movable element 14 with respect to the case 17 toward the valve opening direction X2. Moreover, the movable element 14 is disposed on the valve closing direction X1 side with respect to the magnetic core 16. When the current is supplied to the solenoid 12 by the control of the control device 50, the movable element 14 is attracted toward the valve opening direction X2 side by the magnetic force generated in the magnetic core 16. When the current is supplied to the solenoid 12, the movable element 14 is moved toward the valve opening direction X2 by the energizing force of the zero-position spring 15 and the magnetic force generated in the magnetic core 16 by the current supply to the solenoid 12 in this way. On this occasion, the movable element 14 abuts against the flange 18 of the needle valve 11, thereby pushing upward the flange 18 in the valve opening direction X2. As a result, the movable element 14 and the needle valve 11 integrally move in the valve opening direction X2. Thus, when the tip of the needle valve 11 departs from the valve seat 10 in the valve opening direction X2, the injection opening opens, and the fuel passage is brought into the open state.

When the solenoid 12 transitions from the current supply state to the non-current supply state by the control of the control device 50, the attraction force toward the valve opening direction X2 side applied to the movable element 14 by the magnetic force of the magnetic core 16 disappears, and the needle valve 11 moves toward the valve closing direction X1 by the energizing force toward the valve closing direction X1 of the main spring 13. On this occasion, the flange 18 of the needle valve 11 pushes down the movable element 14 toward the valve closing direction X1, and the needle valve 11 and the movable element 14 integrally move toward the valve closing direction X1. When the tip of the needle valve 11 collides with the valve seat 10 as a result, the movement of the needle valve 11 stops, but the movable element 14 separates from the flange 18, and continues to move toward the valve closing direction X1. Subsequently, the movable element 14 decelerates by the energizing force toward the valve opening direction X2 by the zero-position spring 15, then moves in the valve opening direction X2, and abuts again against the flange 18 to stop.

Figure 2:
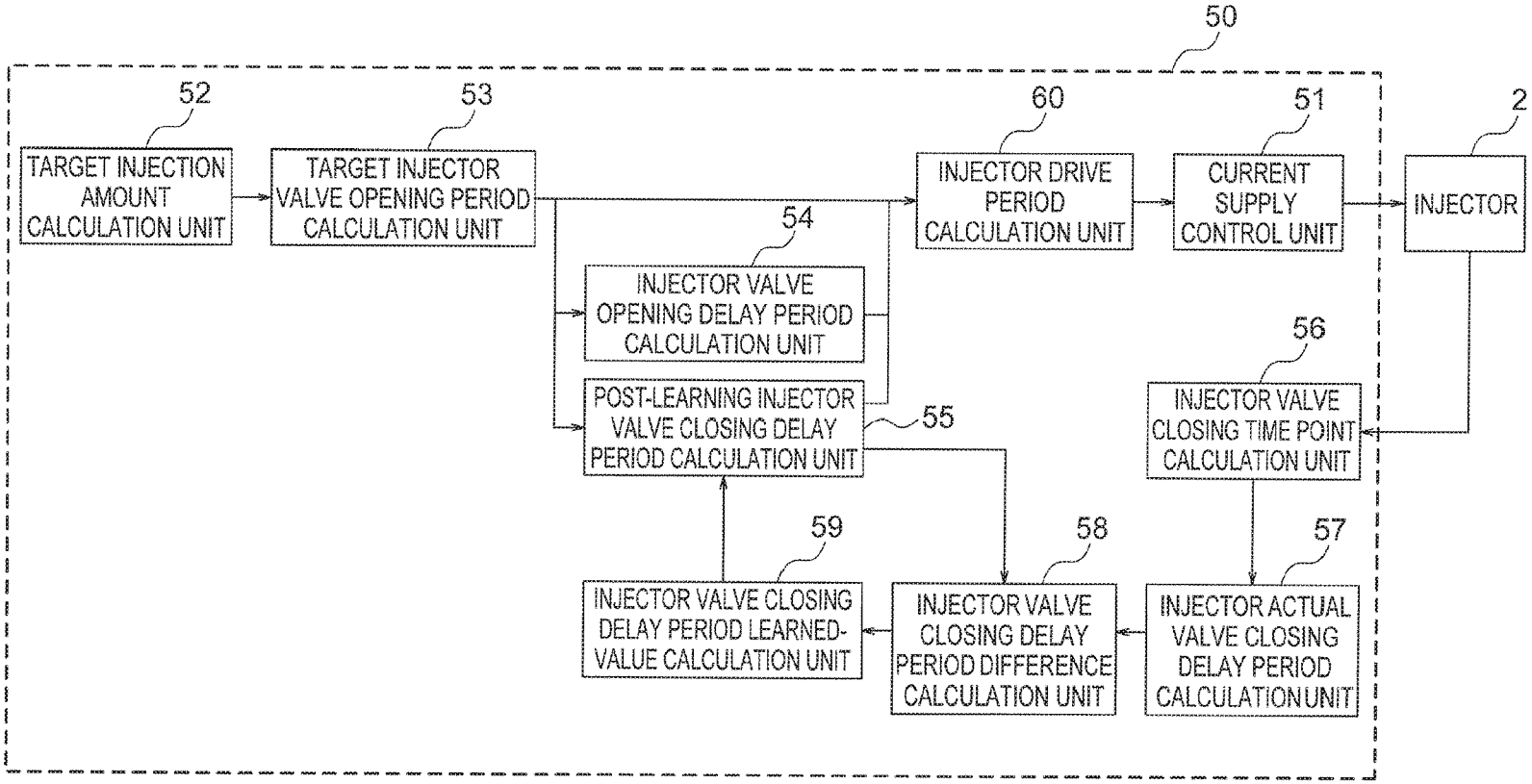
FIG. 2 is a block diagram for illustrating an internal configuration of the injector control device according to the first embodiment of the present invention.

A description is now given of the control device 50. FIG. 2 is a block diagram for illustrating a configuration of the control device 50. As illustrated in FIG. 2, the control device 50 includes a current supply control unit 51, a target injection amount calculation unit 52, a target injector valve opening period calculation unit 53, an injector valve opening delay period calculation unit 54, a post-learning injector valve closing delay period calculation unit 55, an injector valve closing time point calculation unit 56, an injector actual valve closing delay period calculation unit 57, an injector valve closing delay period difference calculation unit 58, an injector valve closing delay period learned-value calculation unit 59, and an injector drive period calculation unit 60.

Figure 3:
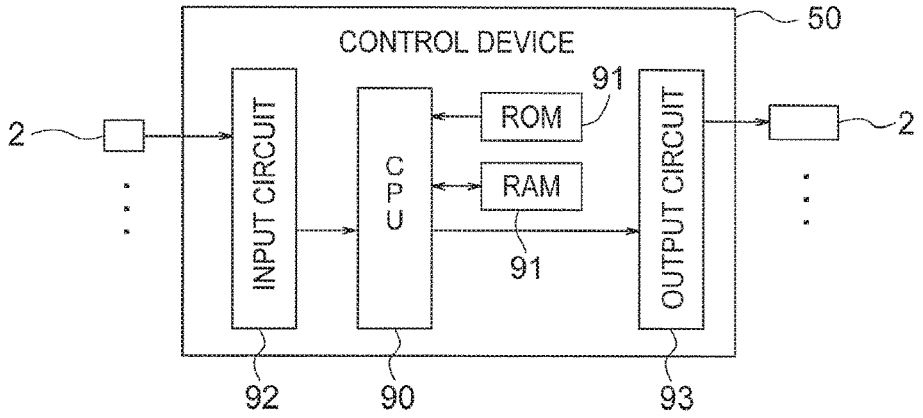
FIG. 3 is a hardware configuration diagram for illustrating a hardware configuration of the injector control device according to the first embodiment of the present invention.

The respective units 51 to 60 of the control device 50 are achieved by a hardware circuit of the control device 50. Specifically, as illustrated in FIG. 3, the control device 50 includes, as the hardware circuit, a calculation processing device 90 constructed by a central processing unit (CPU), a storage device 91 configured to transmit or receive data to or from the calculation processing device 90, an input circuit 92 configured to input signals from the outside to the calculation processing device 90, and an output circuit 93 configured to output signals from the calculation processing device 90 to the outside. The storage device 91 includes a random access memory (RAM) configured so that data can be read and written from the calculation processing device 90, and a read only memory (ROM) configured so that data can be read from the calculation processing device 90. The input circuit 92 includes A/D converters that are connected to various sensors and switches, and are configured to convert output signals from those sensors and switches to digital signals, to thereby input the digital signals to the calculation processing device 90. The output circuit 93 includes drive circuits that are connected to electric loads, and are configured to output control signals from the calculation processing device 90 to those electric loads.

Respective functions of the respective units 51 to 60 of the control device 50 of FIG. 2 are achieved by the calculation processing device 90 executing software, namely, a program stored in the ROM of the storage device 91, and cooperating with the storage device 91, the input circuit 92, the output circuit 93, and other hardware (not shown) of the control device 50. Moreover, a plurality of CPUs and a plurality of memories may cooperate with one another to carry out the above-mentioned functions of the respective units 51 to 60 of the control device 50.

According to the first embodiment, the input circuit 92 includes a terminal voltage detection circuit that is connected to a positive pole terminal and a negative pole terminal of the solenoid 12 of the injector 2, and is configured to output an output signal proportional to a terminal voltage between the positive pole terminal and the negative pole terminal of the solenoid 12. The output signal from the terminal voltage detection circuit is input to the calculation processing circuit 90 via the A/D converter. The terminal voltage detection circuit is constructed by a resistor or a comparator. Moreover, various sensors (not shown) for detecting an operation state of the internal combustion engine, for example, an airflow sensor, a throttle opening degree sensor, and a crank angle sensor, are connected to the input circuit 92.

The output circuit 93 includes an injector drive circuit that is connected to the positive pole terminal and the negative pole terminal of the solenoid 12 of the injector 2, and is configured to control the current supply to the solenoid 12 of the injector 2. The injector drive circuit is constructed by a switching element configured to turn on/off the current supply to the solenoid 12. Although not shown, various actuators for controlling the internal combustion engine, for example, a drive motor for a throttle valve, and an ignition coil, are connected to the output circuit 93. According to the first embodiment, a plurality of the injectors 2 are provided for the internal combustion engine, and the terminal voltage detection circuit and the injector drive circuit are provided for each of the injectors 2. In the following, a description is given of a case where the number of the injectors 2 is one for the sake of simple description. Even in a case where a plurality of the injectors 2 are provided, an operation is the same as that in the case where the number of the injectors 2 is one, and a description thereof is thus herein omitted.

The control device 50 is configured to calculate a fuel injection amount and an ignition timing based on the output signals input from various sensors, and control the drive of the injector 2 and the ignition coil as basic control. Moreover, the control device 50 is configured to detect an intake air amount of the internal combustion engine based on the output signals from various sensors including the airflow sensor, and detect a crank angular velocity and a crank angle of the internal combustion engine based on the output signal of the crank angle sensor.

A description is now given of the respective units 51 to 60 of the control device 50 illustrated in FIG. 2.

<Current Supply Control Unit 51>

The current supply control unit 51 is configured to supply a current to the solenoid 12 of the injector 2. The current supply control unit 51 is configured to issue an instruction of a drive period Td_on of the injector 2, which is calculated by the injector drive period calculation unit 60, namely, an injection pulse width, to the injector 2. The drive period Td_on, namely, the injection pulse width, means a current supply period to the solenoid 12. The injection pulse width may be one of a plurality of divisions of an injection pulse width. The current supply control unit 51 is configured to turn on an injection pulse signal at an injection timing set to a crank angle set in advance for instructing the injector drive circuit to carry out the drive during a period of the injection pulse width, thereby supplying the current to the solenoid 12 in this way. The injector drive circuit is configured to turn on/off one or a plurality of switching elements based on the injection pulse signal. The current supply control unit 51 is configured to store an actual current supply start time point Tstart and the drive period Td_on in the RAM Of the storage device 91.

<Target Injection Amount Calculation Unit 52>

The target injection amount calculation unit 52 is configured to calculate a target fuel injection amount of the injector 2 for achieving a target air fuel ratio set in advance in response to the operation state of the internal combustion engine. The operation state of the internal combustion engine includes the intake air amount detected by the airflow sensor. Moreover, as the operation state of the internal combustion engine, in addition to the intake air amount, for example, the throttle opening degree detected by the throttle opening degree sensor or the crank angle detected by the crank angle sensor may be mentioned, and those parameters may be used.

<Target Injector Valve Opening Period Calculation Unit 53>

The target injector valve opening period calculation unit 53 is configured to use characteristic data on an injector valve opening period corresponding to the target fuel injection amount stored in advance in the ROM of the storage device 91 to calculate a target injector valve opening period Ttgt corresponding to the target fuel injection amount calculated by the target injection amount calculation unit 52. In other words, for example, a lookup table or a characteristic map for defining, in advance, a correspondence between the target fuel injection amount and the target injector valve opening period is stored in advance in the ROM of the storage device 91, and the target injector valve opening period calculation unit 53 is configured to determine the target injector valve opening period corresponding to the target fuel injection amount calculated by the target injection amount calculation unit 52 in accordance with the lookup table or the characteristic map. On this occasion, the target injector valve opening period means a target value of a period from a timing of the valve opening time point at which the valve seat 10 and the needle valve 11 of the injector 2 separate from each other to a timing of the valve closing time point at which the valve seat 10 and the needle valve 11 of the injector 2 abut against each other. Such a description that the characteristic data is stored in advance in the ROM of the storage device 91 is given, but the characteristic data may be stored in the RAM of the storage device 91.

<Injector Valve Opening Delay Period Calculation Unit 54>

The injector valve opening delay period calculation unit 54 is configured to use characteristic data on an injector valve opening delay period with respect to a target injector valve opening period stored in advance in the ROM of the storage device 91 to calculate an injector valve opening delay period Ton with respect to the target injector valve opening period Ttgt calculated by the target injector valve opening period calculation unit 53. In other words, for example, a lookup table or a characteristic map for defining, in advance, a correspondence between the target injector valve opening period and the injector valve opening delay period is stored in advance in the storage device 91, and the injector valve opening delay period calculation unit 54 is configured to determine the injector valve opening delay period Ton with respect to the target injector valve opening period Ttgt calculated by the target injector valve opening period calculation unit 53 in accordance with the lookup table or the characteristic map. On this occasion, the valve opening delay period Ton is a period from the timing of the current supply start time point Tstart of the solenoid 12 to the timing of a valve opening time point at which the valve seat 10 and the needle valve 11 of the injector 2 separate from each other. Such a description that the characteristic data is stored in advance in the ROM of the storage device 91 is given, but the characteristic data may be stored in the RAM.

<Post-Learning Injector Valve Closing Delay Period Calculation Unit 55>

The post-learning injector valve closing delay period calculation unit 55 is configured to use a post-learning injector valve closing delay period with respect to an injector valve opening period in a learning map stored in the RAM of the storage device 91 based on the target injector valve opening period Ttgt calculated by the target injector valve opening period calculation unit 53 to determine a post-learning injector valve closing delay period Tadj with respect to the target injector valve opening period Ttgt. The post-learning injector valve closing delay period Tadj in the learning map stored in the RAM of the storage device 91 is an injector valve closing delay period Tadj calculated by the injector valve closing delay period learned-value calculation unit 59 described later, and is a learned value stored in the learning map. On this occasion, the valve closing delay period Tadj is a period from a timing of a current supply end time point of the solenoid 12 to the timing of the valve closing time point at which the valve seat 10 and the needle valve 11 of the injector 2 abut against each other. On this occasion, when the individual variation of the injector 2 does not exist, the valve closing delay period Tadj matches a period from the timing of the current supply end time point of the solenoid 12 to the timing of the end time point of the target injector valve opening period Ttgt. However, when a variation is generated in the valve closing characteristic of the injector 2 due to a production variation or a secular change in the injector 2, the valve closing delay period Tadj does not match the period, and an injector valve closing delay period difference Tdif described later is generated.

<Injector Valve Closing Time Point Calculation Unit 56>

The injector valve closing time point calculation unit 56 is configured to calculate an actual valve closing time point Tclose of the injector 2. As a calculation method, for example, a drive voltage waveform of the solenoid 12 is detected when the solenoid 12 is driven for the drive period Td_on of the injector 2 calculated by the injector drive period calculation unit 60, and a time point at which the tip of the needle valve 11 actually abuts against the injection opening provided in the valve seat 10 is determined from this drive voltage waveform as the actual valve closing time point Tclose. Alternatively, as another calculation method, for example, a method involving considering a change in the acceleration of the movable element 14 when the needle valve 11 collides with the valve seat 10, detecting the change in the acceleration as a change in an induced electromotive force generated in the voltage between the terminals of the solenoid 12, and determining a timing at which a second-order derivative of the voltage between the terminals becomes maximum as the actual valve closing time point Tclose of the needle valve 11 is conceivable as disclosed in WO 2013/191267 A1. It should be understood that other methods may be employed.

<Injector Actual Valve Closing Delay Period Calculation Unit 57>

The injector actual valve closing delay period calculation unit 57 is configured to calculate an injector actual valve closing delay period Tadj_real based on the actual valve closing time point Tclose calculated by the injector valve closing time point calculation unit 56, and the current supply start time point Tstart and the drive period Td_on stored in advance in the storage device 91. Specifically, the injector actual valve closing delay period Tadj_real is determined according to the following equation.

$$T\text{adj_real}=(T\text{close}-T\text{start})-T\text{d_on}$$

<Injector Valve Closing Delay Period Difference Calculation Unit 58>

The injector valve closing delay period difference calculation unit 58 is configured to calculate a difference Tdif between the injector actual valve closing delay period Tadj_real calculated by the injector actual valve closing delay period calculation unit 57 and the post-learning injector valve closing delay period Tadj calculated by the post-learning injector valve closing delay period calculation unit 55.

<Injector Valve Closing Delay Period Learned Value Calculation Unit 59>

The injector valve closing delay period learned-value calculation unit 59 is configured to use the difference Tdif calculated by the injector valve closing delay period difference calculation unit 58 to update the learned value of the injector valve closing delay period Tadj in the learning map stored in the RAM of the storage device 91. In the learning map, the learned value of the injector valve closing delay period Tadj is stored while the target injector valve opening period is set as at least one learning axis. The number of the learning axes may be one or more. The learning axes may be two axes, which are the target injector valve opening period Ttgt and a battery voltage Vb. Alternatively, the number of axes may be at least three. Examples of other learning axes are described later. The injector valve closing delay period learned-value calculation unit 59 is configured to update the learned value corresponding to the operation condition used in the current learning when the learned value is updated in the learning map. In other words, the target injector valve opening period is set to the learning axis on this occasion, and the learned value corresponding to the target injector valve opening period used in the current learning is thus updated in the learning map when the learned value is updated. In this way, the operation condition used for the learning is set to the learning axis in the learning map, and the learned value is stored while associated with the learning axis. The learned value is used as the injector valve closing delay period for the next calculation timing by the post-learning injector valve closing delay period calculation unit 55. The learned value does not exist at the calculation timing for the first time at which the learning has not been carried out even once, and an initial value of the injector valve closing delay period is thus stored in the ROM of the storage device 91 in advance, and is used for the first time. In the following, the learned value stored in the learning map is referred to as the post-learning injector valve closing delay period Tadj. The battery is usually disposed in a neighborhood of the control device 50, and is used as a power supply to the control device 50 and a drive power supply to the injectors.

Figure 4:
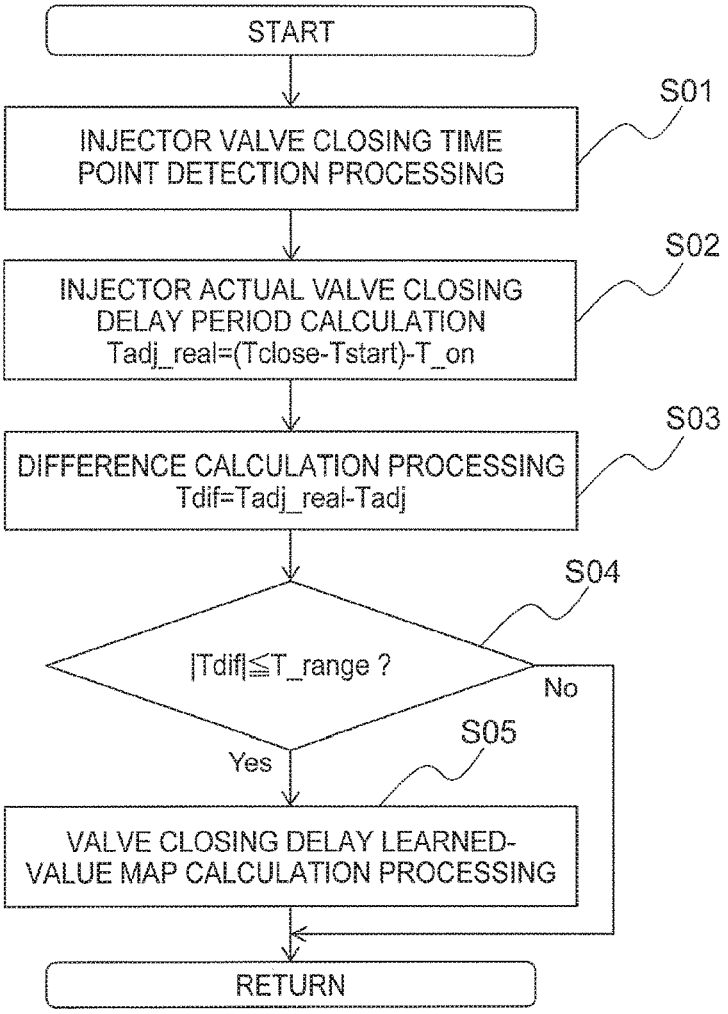
FIG. 4 is a flowchart for illustrating a flow of injector valve closing delay period learned-value calculation processing in the injector control device according to the first embodiment of the present invention.

FIG. 4 is a flowchart for illustrating a flow of processing by the injector valve closing time point calculation unit 56, the injector actual valve closing delay period calculation unit 57, the injector valve closing delay period difference calculation unit 58, and the injector valve closing delay period learned-value calculation unit 59. When the injection of the injector 2 is carried out, the processing of the flowchart of FIG. 4 starts.

First, in Step S01, the injector valve closing time point calculation processing is carried out in the injector valve closing time point calculation unit 56, and the actual valve closing time point Tclose of the injector 2 is determined. As a calculation method for the actual valve closing time point Tclose, any one of the above-mentioned methods is carried out.

Then, in Step S02, the injector actual valve closing delay period calculation unit 57 calculates the injector actual valve closing delay period Tadj_real based on the injector valve closing time point Tclose acquired in Step S01, and the actual current supply start time point Tstart and the drive period Td_on stored in the storage device 91 in advance.

Then, in Step S03, the injector valve closing delay period difference calculation unit 58 calculates the injector valve closing delay period difference Tdif, which is the difference between the injector actual valve closing delay period Tadj_real and the post-learning injector valve closing delay period Tadj, based on the injector actual valve closing delay period Tadj_real acquired in Step S02 and the post-learning injector valve closing delay period Tadj calculated based on the target injector valve opening period Ttgt in the post-learning injector valve closing delay period calculation unit 55.

Then, in Step S04, the injector valve closing delay period learned-value calculation unit 59 determines whether or not the injector valve closing delay period difference Tdif falls within a learning range Trange stored in advance in the storage device 91. Specifically, it is determined whether or not the absolute value of the injector valve closing delay period difference Tdif is equal to or less than a threshold T_range. In other words, the learning range Trange is a range from −T_range to T_range. When the injector valve closing delay period difference Tdif is determined to be in the learning range Trange, that is, "Yes" in Step S04, the processing proceeds to Step S05.

Figure 5:
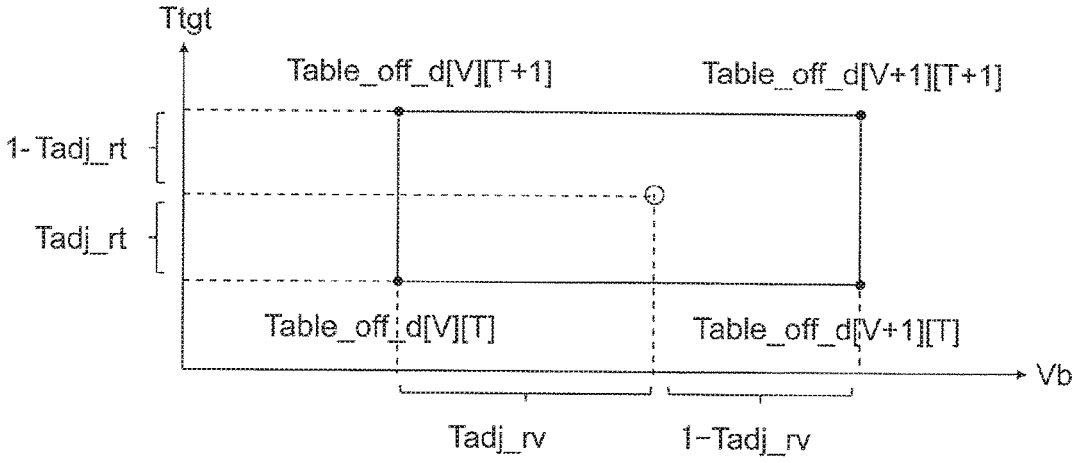
FIG. 5 is a diagram for illustrating a learning map of an injector valve closing delay period learned value used in the injector control device according to the first embodiment of the present invention.

In Step S05, the processing of reflecting the injector valve closing delay period difference Tdif to the injector valve closing delay period learning map is carried out in the injector valve closing delay period learned-value calculation unit 59. In FIG. 5, for example, there is illustrated an example of the learning map of a case where the learning axes of the learning map for the injector valve closing delay period are set to the axes of the target injector valve opening period Ttgt and the battery voltage Vb, and a reflection coefficient to the learned value is Klrn. Respective elements are calculated in accordance with the following equations. The reflection coefficient is usually a value less than 1, and is preferably approximately 0.5. For example, when the reflection coefficient is 0.5, a half of the difference is reflected to the current numerical value of the learned value. Even when the difference rapidly changes, a rapid change in the learned value can be suppressed by multiplying the difference by the reflection coefficient in this way, and a variation of the operation state caused by the rapid change of the learned value can thus be suppressed.

$$\text{Table_off_}d[V][T]=\text{Table_off_}d[V][T]+K_{trn}\times(1-\text{Tadj_}rv)\times(1-\text{Tadj_}rt)\times\text{Tdif}$$

$$\text{Table_off_}d[V+1][T]=\text{Table_off_}d[V+1][T]+K_{trn}\times\text{Tadj_}rv\times(1-\text{Tadj_}rt)\times\text{Tdif}$$

$$\text{Table_off_}d[V][T+1]=\text{Table_off_}d[V][T+1]+K_{trn}\times(1-\text{Tadj_}rv)\times Tadj_rt\times Tdif$$

$$\text{Table_off_}d[V+1][T+1]=\text{Table_off_}d[V+1][T+1]+K_{trn}\times\text{Tadj_}rv\times Tadj_rt\times Tdif$$

Table_off_d[V] [T] is a value after the learning at each map point. On this occasion, [V] denotes an axis point of the battery voltage Vb, and [T] denotes an axis point of the target injector valve opening period Ttgt. Moreover, Tadj_rv is a difference between the battery voltage Vb under an operation condition used for the learning and the axis point of the learning map. Tadj_rt is a difference between the target injector valve opening period Ttgt under the operation condition used for the learning and the axis point of the learning map.

After the respective elements are calculated, thereby updating the learning map in the injector valve closing delay period learned-value calculation unit 59, the processing is finished.

On the other hand, in Step S04, when the injector valve closing delay period difference Tdif is determined to be out of the learning range Trange, that is, the determination in Step S04 is "No", the processing is immediately finished.

As described above, as illustrated in FIG. 5, the learning map having two axes, which are the target injector valve opening period Ttgt and the battery voltage Vb, is created. This is because the operation of the injector 2 is changed by influence of the battery voltage Vb. The valve opening period of the injector 2 is assumed to be changed by various factors, and learning may be carried out for a plurality of learning axes. In addition to the above-mentioned axes, a differential pressure Pdif between a fuel pressure Fp and a cylinder pressure Pcyl may be used as further learning axes. On this occasion, the fuel pressure Fp is a pressure of the fuel supplied to the injector 2. The fuel pressure Fp is measured by a fuel pressure sensor provided on the injector 2. Moreover, the cylinder pressure Pcyl means a pressure inside a cylinder of the internal combustion engine. The cylinder pressure Pcyl may directly be measured by a cylinder pressure sensor provided on the cylinder, or may be predicted from an intake pipe pressure acquired from an intake air pressure sensor provided in an intake pipe or the like. When the differential pressure Pdif between the fuel pressure Fp and the cylinder pressure Pcyl is used as an axis, it is possible to carry out learning adapted to the change in the valve opening period of the injector 2 due to the pressure inside the injector, which is a factor influencing the operation of the injector upon the fuel injection, namely, the fuel pressure of the fuel supplied to the injector 2, and the pressure outside the injector, namely, the pressure inside the cylinder of the internal combustion engine.

As the learned value to be reflected to the learning map, even when an error occurs in the detection of the valve closing time point, the influence of the error on the learned value can be decreased by using only the value inside the learning range Trange set in advance for learning as described above. Moreover, a reflection coefficient may be used when the learned value is reflected. Generation of an operation variation caused by a rapid change in the learned value can be suppressed by using the reflection coefficient. Moreover, the characteristic of the valve closing delay period can be learned for each injector by storing the learning map for each injector in the storage device 91 for the engine including a plurality of injectors, for example, a multi-cylinder engine. Moreover, it should be understood that a single learning map may be used in common for a large number of injectors without providing the learning map for each injector.

The learning adapted to various changes is enabled by using a plurality of learning axes of the learning map in this way. However, the capacity of the storage device 91 is limited, and hence the number of the learning axes may appropriately be determined. According to the first embodiment, the target injector valve opening period has at least one learning axis, and the number of axes may be one or more.

<Injector Drive Period Calculation Unit 60>

Figure 6:
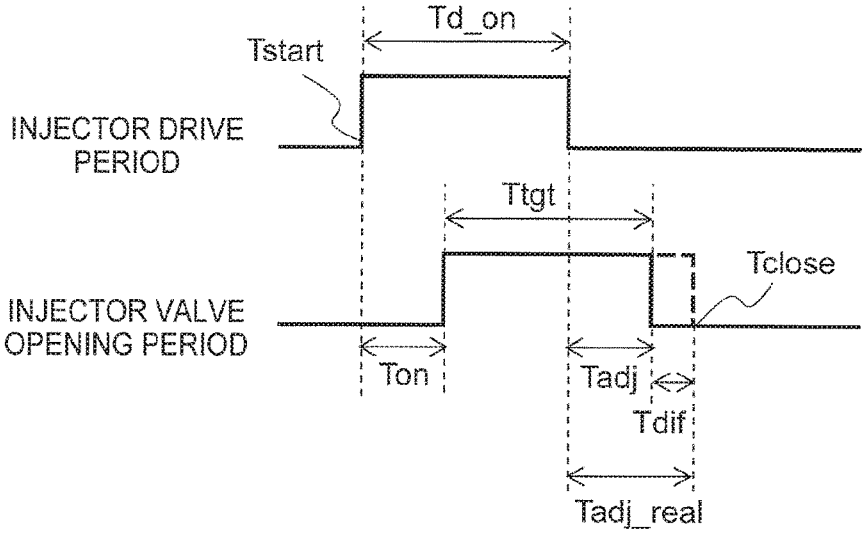
FIG. 6 is a time chart for illustrating a relationship between the injector drive period and an injector valve opening period in the injector control device according to the first embodiment of the present invention.

The injector drive period calculation unit 60 is configured to calculate the current supply period with respect to the solenoid 12 in the current supply control unit 51, namely, the injector drive period Td_on based on the target injector valve opening period Ttgt acquired in the target injector valve opening period calculation unit 53, the injector valve opening delay period Ton acquired in the injector valve opening delay period calculation unit 54, and the post-learning injector valve closing delay period Tadj acquired in the post-learning injector valve closing delay period calculation unit 55. FIG. 6 is a diagram for illustrating a relationship among the injector drive period Td_on, the injector valve opening period Ttgt, the injector valve opening delay period Ton, the post-learning injector valve closing delay period Tadj, the actual injector valve closing time point Tclose, the injector valve closing time point difference Tdif, and the injector actual valve closing delay period Tadj_real.

With this configuration, even when a variation is generated in the valve closing characteristic of the injector 2 by a production variation or a secular change in the injector 2, the variation of the fuel injection amount can be suppressed by learning the injector valve closing delay period Tadj based on the detected injector valve closing time point Tclose, and calculating the current supply period to the solenoid 12 in accordance with the post-learning injector valve closing delay period Tadj. Moreover, even when the valve opening period of the injector 2 changes, the variation of the fuel injection amount can be suppressed by having the learning map of the post-learning injector valve closing delay period Tadj associated with the target injector valve opening period Ttgt and the battery voltage Vb.

Figure 7:
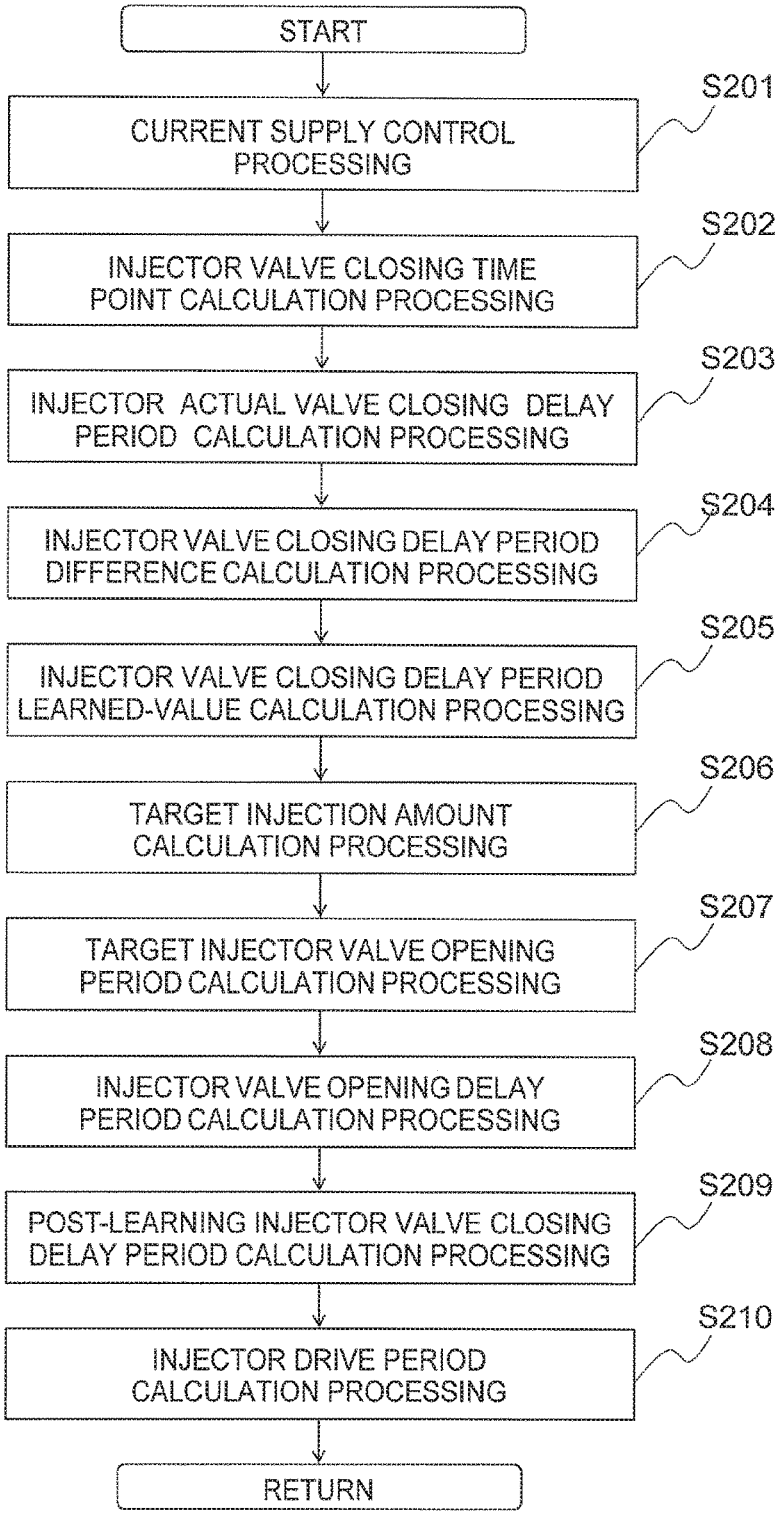
FIG. 7 is a flowchart for illustrating a flow of processing by the injector control device according to the first embodiment of the present invention.

Referring to a flowchart of FIG. 7, a description is now given of a sequence overview of processing by the control device 50 according to the first embodiment, namely, a control method for the internal combustion engine by the control device 50. The processing in the flowchart of FIG. 7 is repeated at a calculation cycle set in advance by the calculation processing device 90 executing software, namely, a program, stored in the storage device 91.

In a current supply control step of Step S201, the current supply control unit 51 carries out the current supply control processing of supplying the current to the solenoid 12 of the injector 2 in accordance with the drive period Td_on of the injector 2 calculated by the injector drive period calculation unit 60 as described above.

Then, in an injector valve closing time point calculation step of Step S202, the injector valve closing time point calculation unit 56 carries out the processing of calculating the injector valve closing time point Tclose in the injector 2 as described above.

In an injector actual valve closing delay period calculation step of Step S203, the injector actual valve closing delay period calculation unit 57 carries out the processing of calculating the injector actual valve closing delay period Tadj_real based on the injector valve closing time point Tclose acquired in Step S202, and the current supply start time point Tstart and the drive period Td_on separately stored in advance.

In an injector valve closing delay period difference calculation step of Step S204, the injector valve closing delay period difference calculation unit 58 carries out the processing of calculating the injector valve closing delay period difference Tdif based on the detected injector actual valve closing delay period Tadj_real and the post-learning injector valve closing delay period Tadj as described above.

In an injector valve closing delay period learned-value calculation step of Step S205, the injector valve closing delay period learned-value calculation unit 59 carries out the processing of reflecting the injector valve closing delay period difference Tdif to the learning map of the injector valve closing delay period when the injector valve closing delay period difference Tdif falls within the learning range Trange as described above.

The processing in Step S202 to Step S205 may not be carried out each time this flowchart is carried out, and may be such decimation processing as to be carried out once every plurality of times. For example, this flowchart is usually carried out for each fuel injection processing for each cylinder. However, each of the pieces of the processing in Step S202 to S205 does not need to be always carried out. In other words, such a rate of the frequency of carrying out the processing in Step S202 to S205 that the processing in Step S202 to Step S205 is carried out once when the execution of the processing in Step S201 and Step S206 to S210 is carried out for a plurality of times may be set in advance in such a way that the processing in Step S202 to Step S205 is carried out once when the execution of this flowchart is carried out twice, the processing is carried out only for a subject cylinder during one cycle, and the processing in Step S202 to Step S205 is not carried out until the engine stops once the learning is determined to be completed during the travel. When the decimation processing is carried out, a calculation load can be decreased. Even when the number of revolutions of the engine increases, the control can be continued while the increase in the load is suppressed, and even when a CPU low in the calculation performance is used, the individual variation among the injectors can effectively be learned.

In a target injection amount calculation step of Step S206, the target injection amount calculation unit 52 carries out the processing of calculating the target fuel injection amount for achieving the target air fuel ratio set in advance based on the operation state of the internal combustion engine.

In a target injector valve opening period calculation step of Step S207, the target injector valve opening period calculation unit 53 carries out, as described above, the processing of using the characteristic data on the injector valve opening period corresponding to the target fuel injection amount stored in advance in the ROM of the storage device 91 based on the fuel injection amount calculated by the target injection amount calculation unit 52 to calculate the target injector valve opening period Ttgt.

In an injector valve opening delay period calculation step of Step S208, the injector valve opening delay period calculation unit 54 carries out, as described above, the processing of using the characteristic data on the injector valve opening delay period corresponding to the injector valve opening period stored in advance in the ROM of the storage device 91 to calculate the injector valve opening delay period Ton.

In a post-learning injector valve closing delay period calculation step of Step S209, the post-learning injector valve closing delay period calculation unit 55 carries out, as described above, the processing of calculating the post-learning injector valve closing delay period Tadj from the result of the learned value of the injector valve opening delay period that corresponds to the injector valve opening period, to which the learned result of the injector valve closing delay period learned-value calculation unit 59 stored in the learning map of the RAM of the storage device 91 is reflected, based on the target injector valve opening period Ttgt.

In an injector drive period calculation step of Step S210, the injector drive period calculation unit 60 carries out the processing of calculating the current supply period to the solenoid 12 in the current supply control unit 51, namely, the drive period of the injector 2 based on the current supply period to the solenoid 12, namely, the target injector valve opening period Ttgt, which is the drive period of the injector 2, the injector valve opening delay period Ton, and the post-learning injector valve closing delay period Tadj.

The current supply period to the solenoid 12 is corrected by carrying out the above-mentioned processing, thereby decreasing the fuel injection amount variation caused by the individual variation of the injector 2.

As described above, with the control device 50 according to the first embodiment, the feedback control is carried out so that the actual injector valve opening period reaches the target injector valve opening period by learning, as the injector valve closing delay period characteristic corresponding to the target injector valve opening period, the difference between the injector valve closing delay period calculated from the target injector valve opening period and the detected actual injector valve closing delay period in accordance with the target injector valve opening period characteristic corresponding to the target injection amount of the injector 2 and the injector valve closing delay period characteristic corresponding to the target injector valve opening period, thereby correcting the current supply period to the solenoid to be actually operated, namely, the injection pulse width. Thus, the variation of the fuel injection amount due to the individual variation of the injector 2 in, for example, the weights and clearances of the spring, the coil, and the needle of the injector 2, and the individual variation of the injector 2 due to the secular change is decreased, thereby enabling the increase in the control accuracy of the fuel injection amount.

What is claimed is:

1. An injector control device, which is configured to control an injector, the injector comprising:

a fuel passage configured to allow a fuel to be injected for an internal combustion engine to pass therethrough;

a needle valve configured to separate from a valve seat provided at a fuel injection opening of the fuel passage to open the fuel passage, and to abut against the valve seat to close the fuel passage; and a solenoid configured to attract the needle valve in a valve opening direction when a current is supplied to the solenoid, the injector control device comprising:

a target injection amount calculation unit configured to calculate a target injection amount of the fuel injected by the injector in response to an operation state of the internal combustion engine;

a target injector valve opening period calculation unit configured to calculate, based on the target injection amount, a target injector valve opening period corresponding to the target injection amount, in accordance with characteristic data on an injector valve opening period with respect to a fuel injection amount;

an injector valve opening delay period calculation unit configured to calculate, based on the target injector valve opening period, a valve opening delay period from a current supply start time point of the solenoid to a valve opening time point at which the valve seat and the needle valve of the injector separate from each other, in accordance with characteristic data on the valve opening delay period with respect to the injector valve opening period;

a post-learning injector valve closing delay period calculation unit configured to calculate, based on the target injector valve opening period, a valve closing delay period from a current supply end time point of the solenoid to a valve closing time point at which the valve seat and the needle valve of the injector abut against each other, in accordance with a learning map having the injector valve opening period as at least one axis and storing a learned value of the valve closing delay period;

an injector drive period calculation unit configured to calculate a current supply period to the solenoid based on the target injector valve opening period, the valve opening delay period, and the valve closing delay period;

a current supply control unit configured to supply the current to the solenoid of the injector in accordance with the current supply period to the solenoid, to thereby drive the injector;

an injector valve closing time point calculation unit configured to detect an actual valve closing time point at which the valve seat and the needle valve actually abut against each other, based on a drive voltage waveform of the solenoid when the current supply control unit drives the injector based on the current supply period to the solenoid;

an injector actual valve closing delay period calculation unit configured to calculate an actual valve closing delay period from the current supply end time point of the solenoid to the actual valve closing time point, based on the actual valve closing time point, an actual current supply start time point of the solenoid, and an actual current supply period to the solenoid;

an injector valve closing delay period difference calculation unit configured to calculate a valve closing delay period difference, which is a difference between the valve closing delay period calculated by the post-learning injector valve closing delay period calculation unit and the actual valve closing delay period calculated by the injector valve closing time point calculation unit; and an injector valve closing delay period learned-value calculation unit configured to update the learned value of the valve closing delay period in the learning map, based on the valve closing delay period difference, the post-learning injector valve closing delay period calculation unit being configured to use, at a next calculation timing, the learning map in which the learned value of the valve closing delay period updated by the injector valve closing delay period learned-value calculation unit is stored, to thereby calculate the valve closing delay period.

2. The injector control device according to claim 1, wherein the injector valve closing delay period learned-value calculation unit is configured to update the learned value when the valve closing delay period difference calculated by the injector valve closing delay period difference calculation unit falls within a predetermined range.

3. The injector control device according to claim 1, wherein the injector valve closing delay period learned-value calculation unit is configured to use a predetermined reflection coefficient to update the learned value in the learning map when the learned value is updated.

4. The injector control device according to claim 1, wherein:

the injector comprises a plurality of injectors; and the learning map is provided for each of the plurality of injectors.

5. The injector control device according to claim 1, further comprising a battery voltage detection unit configured to detect a battery voltage of the internal combustion engine, wherein the learning map is configured to store the learned value while having the injector valve opening period and the battery voltage as axes.

6. The injector control device according to claim 1, further comprising:

a fuel pressure calculation unit configured to carry out one of detection and calculation of a pressure of the fuel supplied to the injector; and a cylinder pressure calculation unit configured to carry out one of detection and calculation of a pressure inside a cylinder of the internal combustion engine into which the fuel is injected, wherein the learning map is configured to store the learned value while having a differential pressure between the pressure of the fuel from the fuel pressure calculation unit and the pressure inside the cylinder from the cylinder pressure calculation unit as a further axis.

7. The injector control device according to claim 1, wherein a number of times of carrying out each of pieces of processing of the injector valve closing time point calculation unit, the injector actual valve closing delay period calculation unit, the injector valve closing delay period difference calculation unit, and the injector valve closing delay period learned-value calculation unit is set in advance to a ratio of once to a plurality of times of carrying out processing of the current supply control unit.

8. An injector control method for controlling an injector, the injector comprising:

a fuel passage configured to allow a fuel to be injected for an internal combustion engine to pass therethrough;

a needle valve configured to separate from a valve seat provided at a fuel injection opening of the fuel passage to open the fuel passage, and to abut against the valve seat to close the fuel passage; and a solenoid configured to attract the needle valve in a valve opening direction when a current is supplied to the solenoid, the injector control method comprising:

a target injection amount calculation step of calculating a target injection amount of the fuel injected by the injector in response to an operation state of the internal combustion engine;

a target injector valve opening period calculation step of calculating, based on the target injection amount, a target injector valve opening period corresponding to the target injection amount, in accordance with characteristic data on an injector valve opening period with respect to a fuel injection amount;

an injector valve opening delay period calculation step of calculating, based on the target injector valve opening period, a valve opening delay period from a current supply start time point of the solenoid to a valve opening time point at which the valve seat and the needle valve of the injector separate from each other, in accordance with characteristic data on the valve opening delay period with respect to the injector valve opening period;

a post-learning injector valve closing delay period calculation step of calculating, based on the target injector valve opening period, a valve closing delay period from a current supply end time point of the solenoid to a valve closing time point at which the valve seat and the needle valve of the injector abut against each other, in accordance with a learning map having the injector valve opening period as at least one axis and storing a learned value of the valve closing delay period;

an injector drive period calculation step of calculating a current supply period to the solenoid based on the target injector valve opening period, the valve opening delay period, and the valve closing delay period;

a current supply control step of supplying the current to the solenoid of the injector in accordance with the current supply period to the solenoid, to thereby drive the injector;

an injector valve closing time point calculation step of detecting an actual valve closing time point at which the valve seat and the needle valve actually abut against each other, based on a drive voltage waveform of the solenoid when the injector is driven in the current supply control step based on the current supply period to the solenoid;

an injector actual valve closing delay period calculation step of calculating an actual valve closing delay period from the current supply end time point of the solenoid to the actual valve closing time point, based on the actual valve closing time point, an actual current supply start time point of the solenoid, and an actual current supply period to the solenoid;

an injector valve closing delay period difference calculation step of calculating a valve closing delay period difference, which is a difference between the valve closing delay period calculated in the post-learning injector valve closing delay period calculation step and the actual valve closing delay period calculated in the injector valve closing time point calculation step; and an injector valve closing delay period learned-value calculation step of updating the learned value of the valve closing delay period in the learning map, based on the valve closing delay period difference, the post-learning injector valve closing delay period calculation step comprising using, at a next calculation timing, the learning map in which the learned value of the valve closing delay period updated in the injector valve closing delay period learned-value calculation step is stored, to thereby calculate the valve closing delay period.

* * * * *